US005434948A

United States Patent [19]

Holt et al.

[11] Patent Number: 5,434,948

[45] Date of Patent: Jul. 18, 1995

[54] POLYPHONIC CODING

[75] Inventors: Christopher E. Holt, Melton; Edward Munday, Ipswich; Barry M. G. Cheetham, Liverpool, all of England

[73] Assignee: British Telecommunications public limited company, London, England

[21] Appl. No.: 109,479

[22] Filed: Aug. 20, 1993

Related U.S. Application Data

[63] Continuation of Ser. No. 834,548, Feb. 12, 1992, abandoned.

[30] Foreign Application Priority Data

Jun. 15, 1989 [GB] United Kingdom ..... 8913758

[51] Int. Cl.[6] ..... G10L 9/00

[52] U.S. Cl. ..... 395/2.29; 395/2; 395/2.1; 395/2.67; 381/51

[58] Field of Search ..... 395/2, 2.24, 2.38, 2.12, 395/2.25–2.28; 381/1, 10, 17, 38, 47, 51, 31

[56] References Cited

U.S. PATENT DOCUMENTS

| | | | |
|---|---|---|---|
| 4,236,039 | 11/1980 | Cooper | 179/1 |
| 4,538,234 | 8/1985 | Honda et al. | 381/31 |
| 4,559,602 | 12/1985 | Bates, Jr. | 395/2 |
| 4,704,730 | 11/1987 | Turner et al. | 395/2.24 |
| 4,852,169 | 7/1989 | Veeneman et al. | 395/2 |
| 4,956,871 | 9/1990 | Swaminathan | 381/31 |
| 4,980,916 | 12/1990 | Zinser | 381/31 |
| 5,012,518 | 4/1991 | Liu et al. | 395/2 |
| 5,040,217 | 8/1991 | Brandenburg et al. | 381/47 |
| 5,042,069 | 8/1991 | Chhatwol et al. | 395/2.38 |
| 5,060,268 | 10/1991 | Asakaw et al. | 381/38 |
| 5,060,269 | 10/1991 | Zinser | 381/38 |
| 5,091,944 | 2/1992 | Takahashi | 381/38 |
| 5,113,437 | 5/1992 | Best et al. | 380/3 |
| 5,142,656 | 8/1992 | Fielder et al. | 381/37 |
| 5,285,498 | 2/1994 | Johnston | 395/2.12 |

OTHER PUBLICATIONS

Nelson et al, "Adaptive inverse filters for stereophonic sound reproduction"; IEEE Transactions on Signal Processing, vol.: 40 Iss: 7 pp. 1621–1632, Jul. 1992.

Minami et al, "Stereophonic ADPCM voice coding method"; ICASSP 90, pp. 1113–1116, 3–6 Apr. 1990.

*Primary Examiner*—Allen R. MacDonald
*Assistant Examiner*—Tariq Hafiz
*Attorney, Agent, or Firm*—Nixon & Vanderhye

[57] ABSTRACT

A polyphonic (e.g. stereo) audioconferencing system, in which input left and right channels are time-aligned by variable delay stages (10*a*, 10*b*), controlled by a delay calculator (9) (e.g. by deriving the maximum cross-correlation value), and then summed in an adder (2) and subtracted in subtracter (3) to form sum and difference signals. The sum signal is transmitted in relatively high quality; the difference signal is reconstructed at the decoder by prediction from the sum signal using an adaptive filter (5). The decoder adaptive filter (5) is configured either by received filter coefficients or, using backwards adaptation, from a received residual signal produced by a corresponding adaptive filter (4) in the coder, or both. Preferably, the adaptive filter (4) is a lattice filter, employing a gradient algorithm for coefficient update. The complexity of the adaptive filter (4) is reduced by pre-whitening, in the encoder, both the sum and difference signals using corresponding whitening filters (14*a*, 14*b*) derived from the sum channel.

17 Claims, 5 Drawing Sheets

1st CHANNEL
(e.g. $x_L + x_R$)
2nd CHANNEL
(e.g. $x_L - x_R$)
12a
ENCODER
12b
ENCODER
13a
LOCAL DECODER
13b
LOCAL DECODER
13c
DECODER
13d
DECODER
4
ADAPTIVE FILTER
P(z)
5
ADAPTIVE FILTER
P(z)

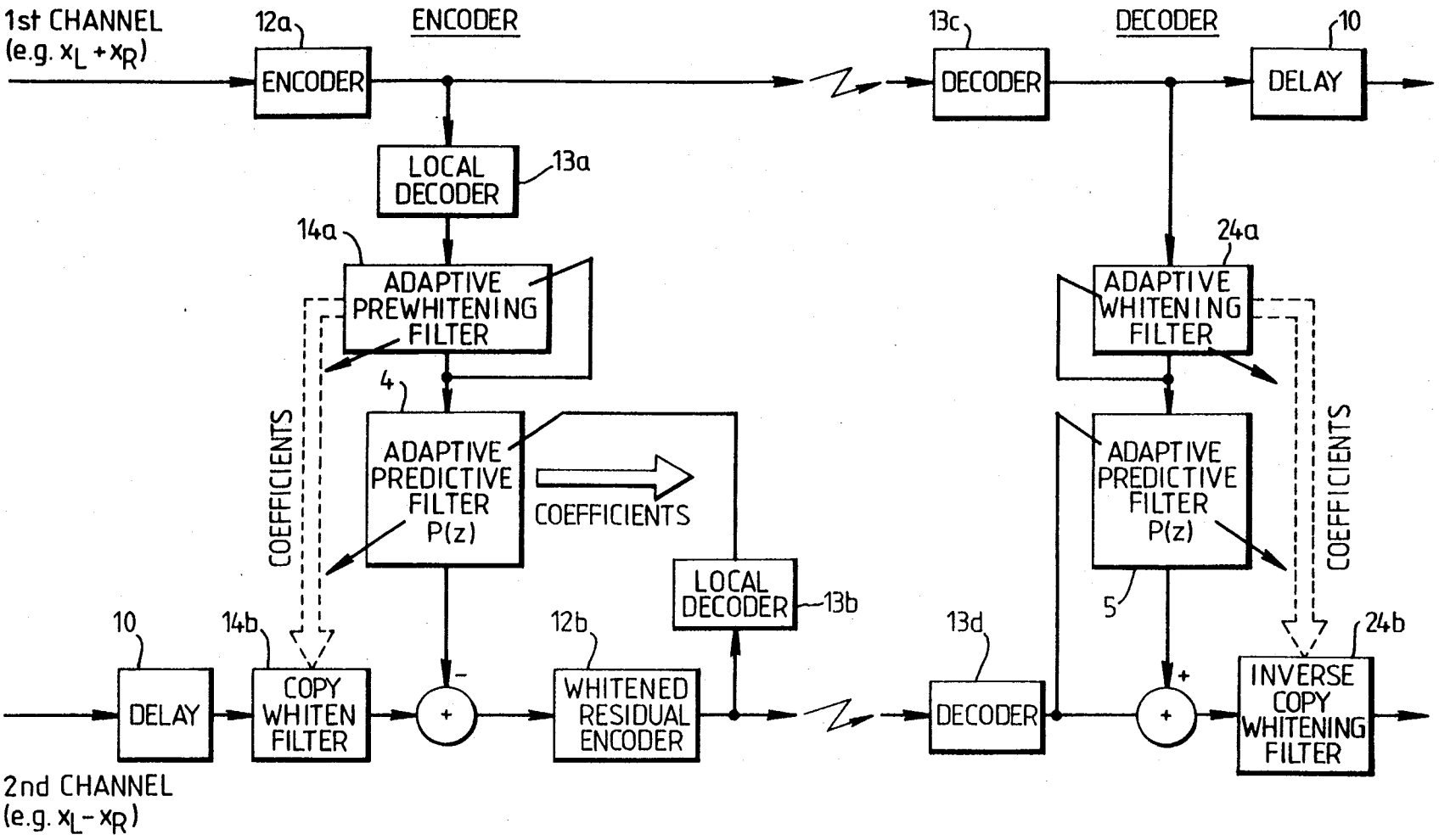
Fig. 5a
ENCODER
1st CHANNEL (e.g. $x_L + x_R$)
12a
ENCODER
13a
LOCAL DECODER
14a
ADAPTIVE PREWHITENING FILTER
4
ADAPTIVE PREDICTIVE FILTER P(z)
COEFFICIENTS
COEFFICIENTS
13b
LOCAL DECODER
12b
WHITENED RESIDUAL ENCODER
14b
COPY WHITEN FILTER
10
DELAY
2nd CHANNEL (e.g. $x_L - x_R$)
13c
DECODER
DECODER
10
DELAY
Fig. 5b
24a
ADAPTIVE WHITENING FILTER
ADAPTIVE PREDICTIVE FILTER P(z)
5
COEFFICIENTS
24b
INVERSE COPY WHITENING FILTER
13d
DECODER

POLYPHONIC CODING

This is a continuation of application Ser. No. 07/834,548, filed Feb. 12, 1992, now abandoned.

This invention relates to polyphonic coding techniques, particularly, but not exclusively, for coding speech signals.

It is well-known that polyphonic, specifically stereophonic, sound is more perceptually appealing than monophonic sound. Where several sound sources, say within a conference room, are to be transmitted to a second room, polyphonic sound allows a spatial reconstruction of the original sound field with an image of each sound source being perceived at an identifiable point corresponding to its position in the original conference room. This can eliminate confusion and misunderstandings during audio-conference discussions since each participant may be identified both by the sound of his voice and by his perceived position within the conference room.

Inevitably, polyphonic transmissions require an increase in transmission capacity as compared with monophonic transmissions. The conventional approach of transmitting two independent channels, thus doubling the required transmission capacity, imposes an unnaceptably high cost penalty in many applications and is not possible in some cases because of the need to use existing channels with fixed transmission capacities.

In stereophonic (i.e. two-channel polyphonic) systems, two microphones (hereinafter referred to as left and right microphones), at different positions, are used to pick up sound generated within a room (for example by a person or persons speaking). The signals picked up by the microphones are in general different. Each microphone signal (referred to hereinafter as $x_L(t)$ with Laplace transform $X_L(s)$ and $x_R(t)$ with Laplace transform $X_R(s)$ respectively) may be considered to be the superposition of source signals processed by respective acoustic transfer functions. These transfer functions are strongly affected by the distances between the sound sources and each microphone and also by the acoustic properties of the room. Taking the case of a single source, e.g. a single person speaking at some fixed point within the room, the distances between the source and the left and right microphones give rise to different delays, and there will also be different degrees of attenuation. In most practical environments such as conference rooms, the signal reaching each microphone may have travelled via many reflected paths (e.g. from walls or ceilings) as well as directly, producing time spreading, frequency dependent colouration due to resonances and antiresonances, and perhaps discrete echos.

From the foregoing, in theory, the signal from one microphone may be formally related to that from the other by designating an interchannel transfer function H say; i.e. $X_L(s)=H(s)\ X_R(s)$ where s is complex frequency parameter. This statement is based on an assumption of linearity and time-invariance for the effect of room acoustics on a sound signal as it travels from its source to a microphone. However, in the absence of knowledge as to the nature of H, this statement does no more than postulate a correlation between the two signals. Such a postulation seems inherently sensible, however, at least in the special case of a single sound source, and therefore one way of reducing the bit-rate needed to represent stereo signals should be to reduce the redundancy of one relative to the other (to reduce this correlation) prior to transmission and re-introduce it after reception.

In general, H(s) is not unique and can be signal- and time- dependent. However when the source signals are white and uncorrelated, i.e. when their autocorrelation functions are zero except at $t=0$ and their cross-correlation functions are zero for all t, H(s) will depend on factors not subject to rapid change, such as room acoustics and the positions of the microphones and sound sources, rather than the nature of the source signals which may be rapidly changing.

To realise such a system in physical form, the fundamental problems of causality and stability must be overcome. Consider for a moment a single source signal which is delayed by $d_L$ seconds before reaching the left microphone and by $d_R$ seconds before reaching the right microphone (although the point to be made has more general implications). If the source is near to, say, the left microphone, then $d_L$ will be smaller than $d_r$. The interchannel transfer function H(s) must delay $x_L(t)$ by the difference between the two delays, $d_R-d_L$ to produce the right channel $x_R(t)$. Since $d_R-d_L$ is positive, H(s) will be causal. If the signal source is now moved closer to the right microphone than to the left, $d_R-d_L$ becomes negative and H(s) becomes non-causal; in other words, there is no causal relationship between the right channel and the left channel, but rather the reverse so the right channel can no longer be predicted from the left channel, since a given event occurs first in the right channel. It will therefore be realised that a simple system in which one fixed channel is always transmitted and the other is reconstructed from it is impossible to realise in a direct sense.

According to a first aspect of the invention, there is provided a polyphonic signal coding apparatus comprising:

means for receiving at least two input channels from different sources;

means for producing a sum channel representing the sum of such signals, and for producing at least one difference channel representing a difference therebetween;

means for periodically generating a plurality of parametric coefficients which, if applied to a plural order predictor filter, would enable the prediction of the difference channel from the sum channel thus filtered; and means for outputting data representing the said sum channel and data enabling the reconstruction of the said difference channel therefrom.

In a first embodiment, the difference signal reconstruction data are filter coefficients. In a second embodiment, the residual signal representing the difference between the difference signal and the sum signal when thus filtered is formed at the transmitter, and this is transmitted as the difference signal reconstruction data. In this embodiment, the prediction residual signal may be efficiently encoded to allow an backward adaptation technique to be used at the decoder for deriving the prediction filter coefficients. The residual is also used as an error signal which is added to the prediction filter's output at the decoder to correct for innaccuracies in the prediction of the difference channel from the sum channel. This "residual only" embodiment is also useful where the left channel, say, is predicted from the right channel (without forming sum and difference signals-)—provided suitable measures are taken to ensure causality—to give high quality polyphonic reproduction. In a third embodiment, both are transmitted.

Preferably, the means for generating the filter coefficients is an adaptive filter, advantageously a lattice filter. This type of filter also gives advantages in non-sum and difference polyphonic systems.

In preferred embodiments, variable delay means are disposed in at least one of the input signal paths, and controlled to time align the two signals prior to forming the sum and difference signals so that causal prediction filters of reasonable order can be used.

This aspect of the invention has several important advantages:

(i) The 'sum signal' is fully compatible with monophonic encoding and is unaffected by the polyphonic coding except for the introduction of an imperceptible delay. In the event of loss of stereo, monophonic back-up is thus available.

(ii) The sum signal may be transmitted by conventional low bit-rate coding techniques (eg. LPC) without modification.

(iii) The encoding technique for the difference signals can be varied to suit the application and the available transmission capacity between the above three embodiments. The type of residual signal and prediction coefficients can also be selected in various different ways, while still conforming to the basic encoding principle.

(iv) Overall, the apparatus encodes polyphonic signals with only a modest increase in bit-rate requirement as compared with monophonic transmission.

(v) The encoding is digital and hence the performance of the apparatus will be predictable, not subject to ageing effects or component drift and easily mass-produced.

A method of calculating approximations to H(s) when the source signals are not white (which, of course, includes all speech or music signals) is proposed in a second aspect of the invention, using the idea of a 'prewhitening filter'.

According to a second aspect of the invention, there is provided a polyphonic signal coding apparatus comprising:

means for receiving at least two input channels;

means for filtering each input channel in accordance with a filter approximating the spectral inverse of a first of said channels to produce respective filtered chanels, the first said filtered channel thereby being substantially spectrally whitened;

means for receiving said filtered chanels and for periodically generating parametric data for each filtered channel (other than said first), which would enable the prediction of each input channel from said first; and means for outputting data representing the first channel, and data representing said parametric data.

This aspect of the invention provides, as above, the advantages of a digital system compatible with existing techniques and simplifies the process of modelling (at the encoder) the required interchannel transfer function.

Broadly corresponding decoding apparatus is also provided according to the invention, as are systems including such encoding and decoding apparatus, particularly in an audioconferencing application, but also in a polyphonic recording application. Other aspects of the invention are as claimed and disclosed herein.

The words "prediction" and "predictor" in this specification include not only prediction of future data from past data, but also estimation of present data of a channel from past and present data of another channel.

The invention will now be illustrated, by way of example only, with reference to the accompanying drawings in which.

Figure 3A:
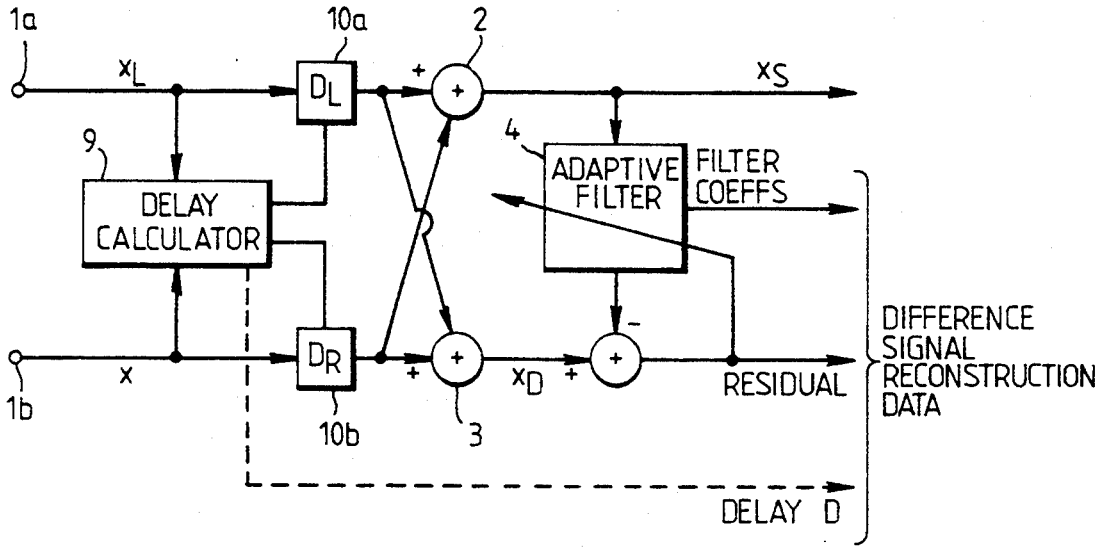
Figure 3B:
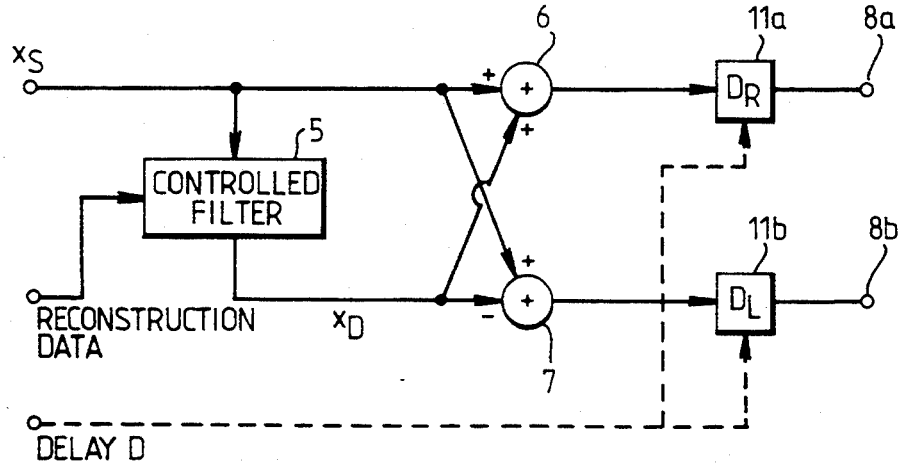
Figures 4A, 4B:
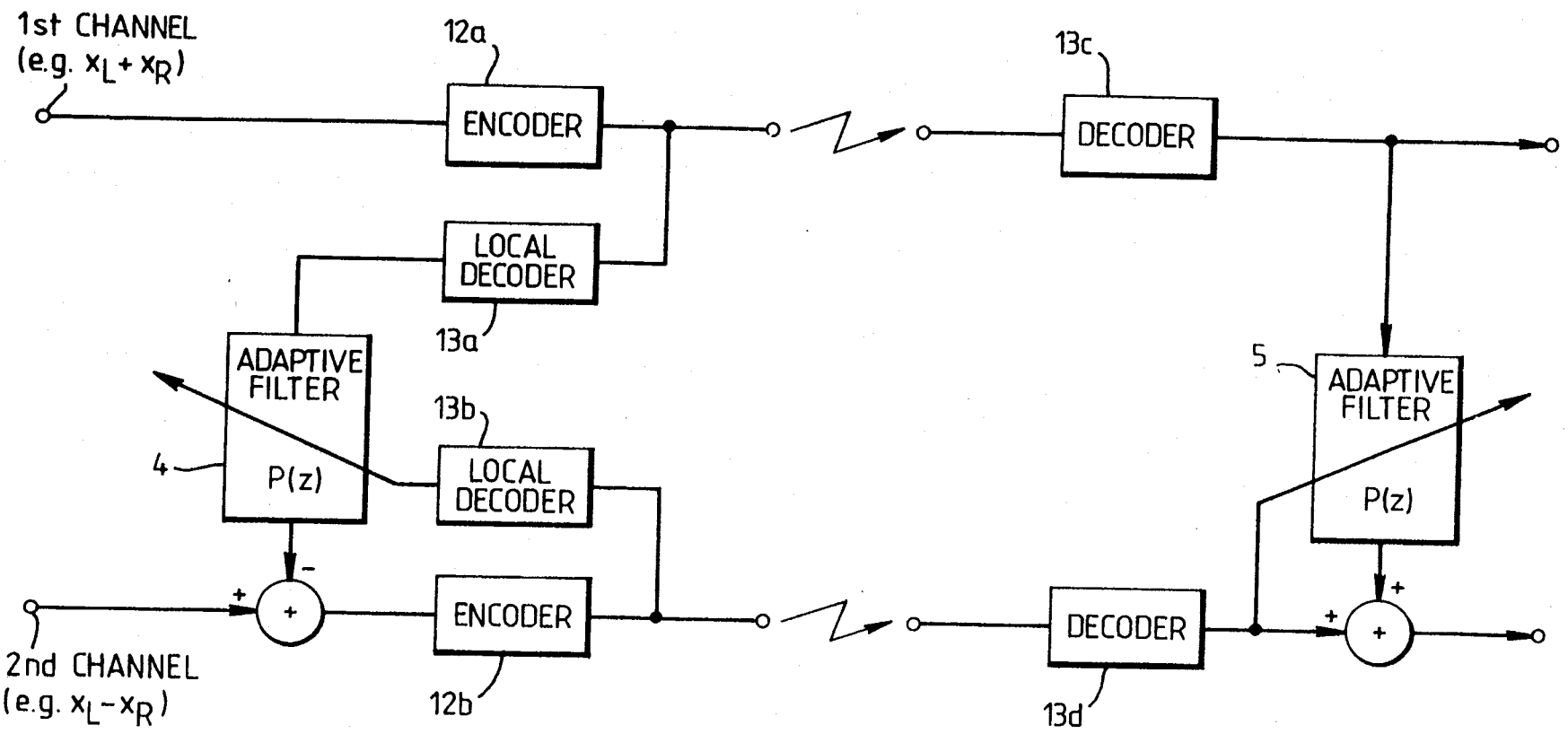

FIG. 3*a* illustrates an encoder according to a preferred embodiment of the invention;

FIG. 3*b* illustrates a corresponding decoder;

FIGS. 4*a* and 4*b* show respectively a corresponding encoder and decoder according to a second aspect of the invention.

Figure 6:
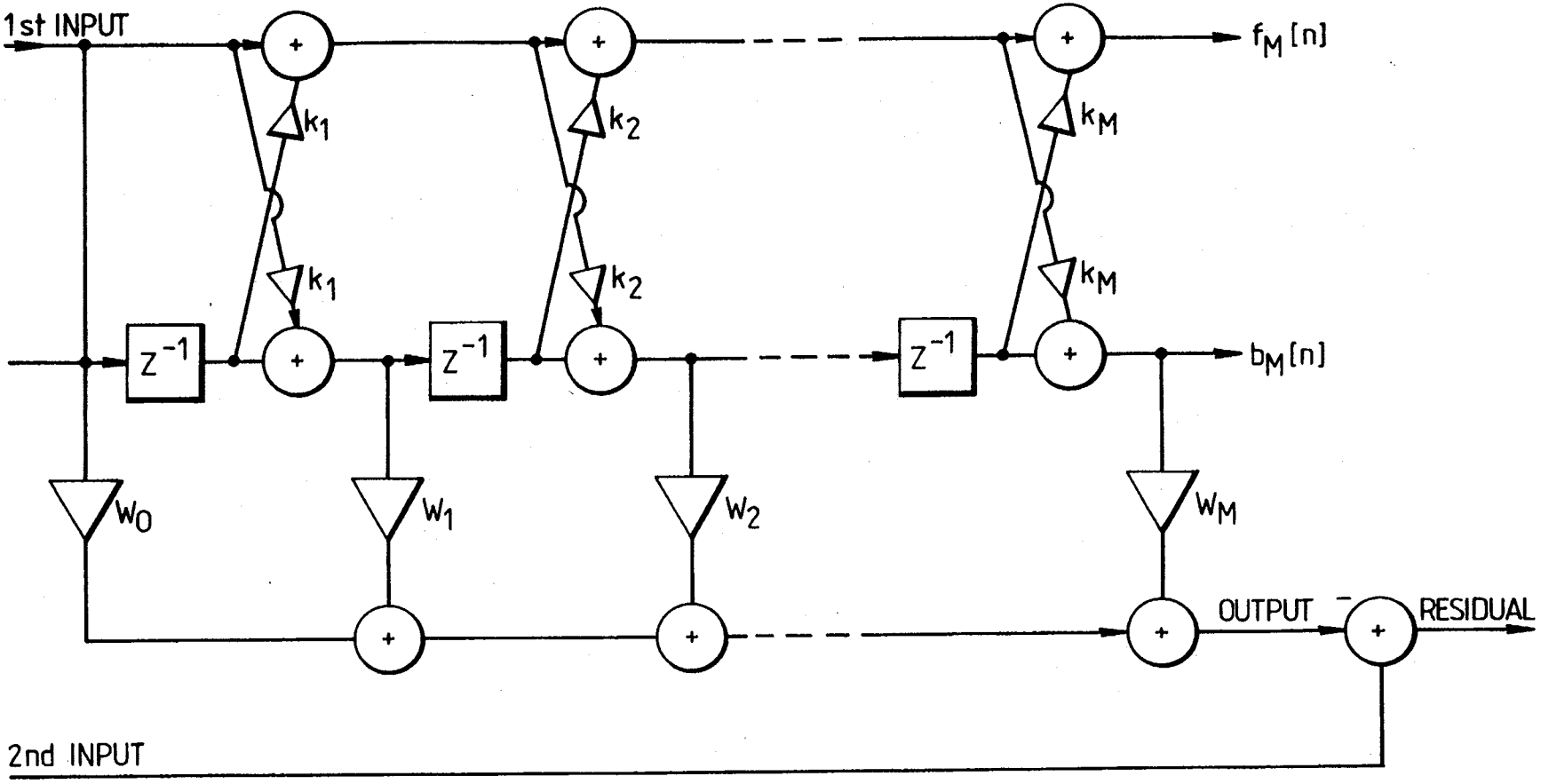

FIGS. 5*a* and 5*b* illustrate an encoder and a decoder according to a second aspect of the invention;

FIG. 6 illustrates part of an encoder according to a yet further embodiment of the invention.

The embodiments illustrated are restricted to 2 channels (stereo) for ease of presentation, but the invention may be generalised to any number of channels. One possible way of removing the redundancy between two input signals (or predicting one from the other) would be to connect between the two channels an adaptive predictor filter whose slowly changing parameters are calculated by standard techniques (such as, for example, block cross-correlation analysis or sequential lattice adaptation). In an audioconferencing environment, the two signals will originate from sound sources within a room, and the acoustic transfer function between each source and each microphone will be characterised typically by weak poles (from room resonances) and strong zeros (due to absorption and destructive interference). An all-zero filter could therefore produce a reasonable approximation to the acoustic transfer function between a source and a microphone and such a filter could also be used to predict say the left microphone signal $x_L(t)$ from $x_R(t)$ when the source is close to the right microphone. However, if the source were now moved away from the right microphone and placed close to the left, the nature of the required filter would be effectively inverted even when delays are introduced to guarantee causality. The filter must now model a transfer function with weak zeros and strong poles—a difficult task for an all-zero filter. Other types of filter are not, in general, inherently stable. The net effect of this is to cause unequal degradation in the reconstructed channel when the source shifts from one microphone to the other. This further makes the simplistic prediction of one channel (say, the left) from the other (say, the right) hard to realise.

In a system according to the first aspect of the invention, better results have been obtained by forming a "sum signal" $x_S(t)=x_L(t)+x_R(t)$ and predicting either a difference signal $x_D(t)=x_L(t)-x_R(t)$ or simply $x_L(t)$ or $x_R(t)$ using an all-zero adaptive digital filter.

In practice, $x_R(t)$ and $x_L(t)$ (or $x_S(t)$ and $x_D(t)$) will be processed in sampled data form as the digital signals $x_R[n]$ and $x_L[n]$ (or $x_S[n]$ and $x_D[n]$) and it will be more convenient to use the 'z-transform' transfer fuction H(z) rather than H(s).

Figure 1:
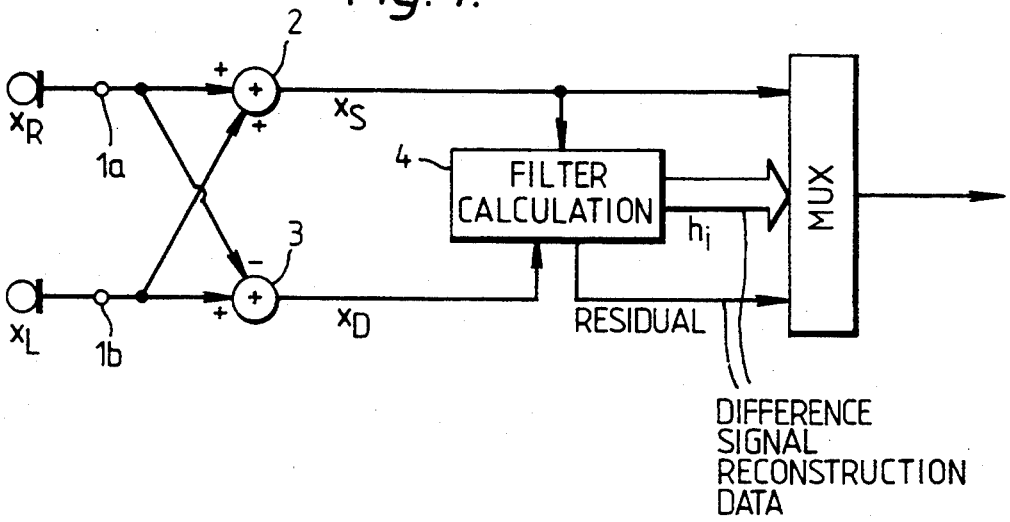
FIG. 1 illustrates generally an encoder according to a first aspect of the invention.

Referring to FIG. 1, in its essential form the invention comprises a pair of inputs 1*a*, 1*b* for receiving a pair of speech signals, e.g. from left and right microphones. The signals at the inputs, $x_R(t)$ and $x_L(t)$, may be in digital form. It may be convenient at this point to preprocess the signals, e. g. by band limiting. Each signal is then supplied to an adder 2 and a subtractor 3, the output of the adder being the sum signal $x_S(t)=x_R(t)+x_L(t)$, and the output of the subtracter 3 being the difference signal $x_L(t)-x_R(t)+x_L(t)$ i.e. $X_D(t)=H(s)\ X_S(s)$. The sum and difference signals are then supplied to filter derivation stage 4, which derives the coefficients of a multi-stage prediction filter which, when driven with the sum signal, will approximate the difference signal. The difference between the approximated difference signal and the actual difference signal, the prediction residual signal, will usually also be produced (although this is not invariably necessary). The sum signal is then encoded (preferably using LPC or sub-band coding), for transmission or storage, along with further data enabling reconstruction of the difference signal. The filter coefficients may be sent, or alternatively (as discussed further below), the residual signal may be transmitted, the difference channel being reconstituted by deriving the filter parameters at the receiver using a backwards adaptive process known in the art; or both may be transmitted.

Although it would be possible to calculate filter parameters directly (using LPC analysis techniques), one simple and effective way of providing the derivation stage 4 is to use an adaptive filter (for example, an adaptive transversal filter) receiving as input the sum channel and modelling the difference channel so as to reduce the prediction residual. Such general techniques of filter adaptation are well-known in the art.

Our initial experiments with this structure have used a transversal FIR filter with coefficient update by an algorithm for minimising the mean square value of the residual, which is simple to implement. The filter coefficients change only slowly because the room acoustic (and hence the interchannel transfer function) is relatively stable.

Figure 2:
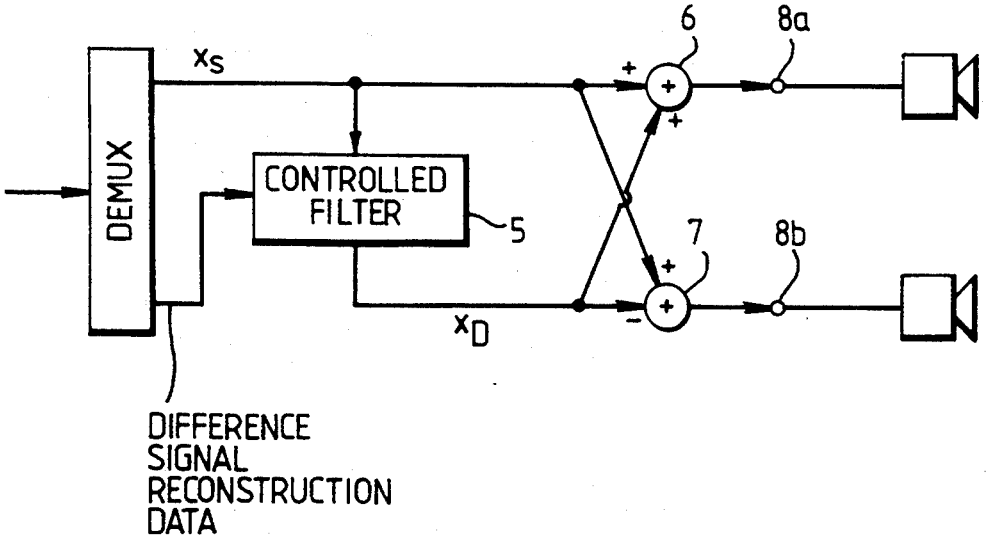
FIG. 2 illustrates generally a corresponding decoder.

Referring to FIG. 2, in a corresponding receiver, the sum signal $x_S(t)$ is received together with either the filter parameters or the residual signal, or both, for the difference channel, and an adaptive filter 5 corresponding to that for which the parameters were derived at the coder receives as input the sum signal and produces as output the reconstructed difference signal when configured either with the received parameters or with parameters derived by backwards adaptation from the received residual signal. Sum and difference signals are then both fed to an adder 6 and a subtracter 7, which produce as outputs respectively the reconstructed left and right channels at output nodes 8*a* and 8*b*.

Since a high-quality sum signal is sent, the encoder is fully mono-compatible. In the event of loss of stereo information, monophonic back-up is thus available.

As discussed above, one component of the transfer functions $H_L$ and $H_R$ is a delay component relating to the direct distance between the signal source and each of the microphones, and there is a corresponding delay difference d. There is thus a strong cross-correlation between one channel and the other when delayed by d.

This method, however, requires considerable processing power.

An alternative method of delay estimation found in papers on sonar research is to use an adaptive filter. The left channel input is delayed by half the filter length and the coefficients are updated using the LMS algorithm to minimise the mean-square error or the output. The transversal filter coefficients will, in theory, become the required cross-correlation coefficients. This may seem like unnecessary repetition of filter coefficient derivation were it not for the property of this delay estimator that the maximum value of the cross-correlation coefficient (at the position of the maximum filter coefficient) is obtained some time before the filter has converged. This method may be improved further because spatial information is also available from the relative amplitudes of the input channels; this could be used to apply a weighting function to the filter coefficients to speed convergence.

Referring to FIG. 3*a*, in a preferred embodiment of the invention, the complexity and length of the filter to be calculated is therefore reduced by calculating the required value of d in a delay calculator stage 9 (preferably employing one of the above methods), and then bringing the channels into time alignment by delaying one or other by d using, for example, a pair of variable delays 10*a*, 10*b* (although one fixed and one variable delay could be used) controlled by the delay calculator 9. With the major part of the speech information in the channels time aligned, the sum and difference signals are then formed.

Referring to FIG. 3*b*, the delay length d is preferably transmitted to the decoder, so that after reconstructing the difference channel and subsequently the left and right channels, corresponding variable length delay stages 11*a*, 11*b* in one or other of the channels can restore the interchannel delay.

In the illustrated structure, the "sum" signal is thus no longer quite the true sum of $x_L(t)+x_R(t)$; because of the delay d it is $x_L(t)+x_R(t-d)$. It may therefore be preferred to locate the delays 10*a*, 10*b* (and, possibly, the delay calculator) downstream of the adder and subtractor 2 and 3; this gives, for practical purposes, the same benefits of reducing the necessary filter length.

In practice, the delay is generally imperceptible; typically, up to 1.6 ms. Alternatively, a fixed delay, sufficiently long to guarantee causality, may be used, thus removing the need to encode the delay parameter.

In the first embodiment of the invention, as stated above, only the filter parameters are transmitted as difference signal data. With 16 bits per coefficient, this meant that a transmission capacity of 5120 bits/sec is needed for the difference channel (plus 8 bits for the delay parameter). This is well within the capacity of a standard 64 kbit/sec transmission system used which allocates 48 kbits/sec to the sum channel (efficiently transmitted by an existing monophonic encoding technique) and offers 16 kbits/sec for other "overhead" data. This mode of the embodiment gives a good signal to noise ratio and the stereo image is present, although it is highly dependent on the accuracy of the algorithm used to adapt the predictive filter. Inaccuracies tend to cause the stereo image to wander during the course of a conference particularly when the conversation is passed from one speaking person to another at some distance from the first.

Referring to FIG. 4*a*, in a second embodiment of the invention, only the residual signal is transmitted as difference signal data. The sum signal is encoded (12*a*) using, for example, sub-band coding. It is also locally decoded (13*a*) to provide a signal equivalent to that at the decoder, for input to adaptive filter 4. The residual difference channel is also encoded (possibly including bandlimiting) by residual coder 12*b*, and a corresponding local decoder 13*b* provides the signal minimised to adaptive filter 4. The advantage this creates is that inaccuracies in generating the parameters cause an increase in the dynamic range of the residual channel and a corresponding decrease in SNR, but with no loss in stereo image.

Referring to FIG. 4*b*, at the decoder, the analysis filter parameters are recovered from the transmitted residual by using a backwards-adapting replica filter 5 of the adaptive filter 4 at the coder. Decoders 13*c*, 13*d* are identical to local decoders 13*a*, 13*b* and so the filter 5 receives the same inputs, and thus produces the same parameters, as that of encoder filter 4.

In a further embodiment (not shown), both filter parameters and residual signal are transmitted as side-information, overcoming many of the problems with the residual-only embodiment because the important stereo information in the first 2 kHz is preserved intact and the relative amplitude information at higher frequencies is largely retained by the filter parameters.

Both the above residual-only and hybrid (i.e. residual plus parameters) embodiments are preferably employed, as described, to predict the difference channel from the sum channel. However, it is found that the same advantages of retaining the stereo image (albeit with a decrease in SNR) are found when the input channels are left and right, rather than sum and difference, provided the problem of causality is overcome in some manner (e.g. by inserting a relatively long fixed delay in one or other path). The scope of the invention therefore encompasses this also.

The parameter-only embodiment described above preferably uses a single adaptive filter 4 to remove redundancy between the sum and difference channels. An effect discovered during testing was a curious 'whispering' effect if the coefficients were not sent at a certain rate, which was far above what should have been necessary to describe changes in the acoustic environment. This was because the adaptive filter, in addition to modelling the room acoustic transfer function, was also trying to perform an LPC analysis of the speech.

This is solved in the second aspect of the invention by whitening the spectra of the input signals to the adaptive filter as shown in FIG. 5, so as to reduce the rapidly-changing speech component leaving principally the room acoustic component.

In the second aspect of the invention, the adaptive filter 4 which models the acoustic transfer functions may be the same as before (for example, a lattice filter of order 10). The sum channel is passed through a whitening filter 14*a* (which may be lattice or a simple transversal structure).

The master whitening filter 14*a* receives the sum channel and adapts to derive an approximate spectral inverse filter to the sum signal (or, at least, the speech components thereof) by minimising its own output. The output of the filter 14*a* is therefore substantially white. The parameters derived by the master filter 14*a* are supplied to the slave whitening filter 14*b*, which is connected to receive and filter the difference signal. The output Of the slave whitening filter 14*b* is therefore the difference signal filtered by the inverse of the sum signal, which substantially removes common signal components, reducing the correlation between the two and leaving the output of 14*b* as consisting primarily of the acoustic response of the room. It thus reduces the dynamic range of the residual considerably.

The effect is to whiten the sum channel and to partially whiten the difference channel without affecting the spectral differences between them as a result of room acoustics, so that the derived coefficients of adaptive filter 4 are model parameters of the room acoustics.

In one embodiment, the coefficients only are transmitted and the decoder is simply that of FIG. 2 (needing no further filters). In this embodiment, of course, residual encoder 12*b* and decoder 13*b* are omitted.

An adaptive filter will generally not be long enough to filter out long-term information, such as pitch information in speech, so the sum channel will not be completely "white". However, if a long-term predictor (known in LPC coding) is additionally employed in filters 14*a* and 14*b*, then filter 4 could, in principle, be connected to filter the difference channel alone, and thus to model the inverse of the room acoustic.

Since this second aspect of the invention reduces the dynamic range of the residual, it is particularly advantageous to employ this whitening scheme with the residual-only transmission described above. In this case, prior to backwards adaptation at the decoder, it is necessary to filter the residual using the inverse of the whitening filter, or to filter the sum channel using the whitening filter. Either filter can be derived from the sum channel information which is transmitted.

Referring to FIG. 5*b*, in residual-only transmission, an adaptive whitening filter 24*a* (identical to 14*a* at the encoder) receives the (decoded) sum channel and adapts to whiten its output. A slave filter 24*b* (identical to 14*b* at the encoder) receives the coefficients of 24*a*. Using the whitened sum channel as its input, and adapting from the (decoded) residual by backwards adaptation, adaptive filter 5 regenerates a filtered signal which is added to she (decoded) residual and the sum is filtered by slave filter 24*b* to yield the difference channel. The sum and difference channels are then processed (6, 7 not shown) to yield the original left and right channels.

In a further embodiment (not shown), both residual and coefficients are transmitted.

Although this pre-whitening aspect of the invention has been described in relation to the preferred embodiment of the invention using sum and difference channels, it is also applicable where the two channels are 'left' and 'right' channels.

For a typical audioconferencing application, the residual will have a bandwidth of 8 kHz and must be quantised and transmitted using spare channel capacity of about 16 kbit/s. The whitened residual will be, in principle, small in mean square value, but will not be optimally whitened since the copy pre-whitening filter 14*b* through which the residual passes has coefficients derived to whiten the sum channel and not necessarily the difference channel. Typically, the dynamic range of the filtered signal is reduced by 12 dB over the unfiltered difference channel. One approach to this residual quantisation problem is to reduce the bandwidth of the residual signal. This allows downsampling to a lower rate, with a consequential increase in bits per sample. It is well known that most of the spatial information in a stereo signal is contained within the 0–9 kHz band, and therefore reducing the residual bandwidth from 8 kHz to a value in excess of 2 kHz does not affect the perceived stereo image appreciably. Results have shown that reducing the residual bandwidth to 4 kHz (and taking the upper 4 kHz band to be identical to that of the sum channel) produces good quality stereophonic speech when the reduced bandwidth residual is sub-band coded using a standard technique.

Experiments with various adaptive filters for the filter 4 (and, where applicable, 12) showed that a standard transversal FIR filter was slow to converge. A faster performance can be obtained by using a lattice structure, with coefficient update using a gradient algorithm based on Burg's method, as shown in FIG. 6.

The structure uses a lattice filter 14*a* to pre-whiten the spectrum of the primary input. The decorrelated backwards residual outputs are then used as inputs to a simple linear combiner which attempts to model the input spectrum of the secondary input. Although the modelling process is the same as with the simple transversal FIR filter, the effect of the lattice filter is to point the error vector in the direction of the optimum LMS residual solution. This speeds convergence considerably. A lattice filter of order 20 is found effective in practice.

The lattice filter structure is particularly useful as described above, but could also be used in a system in which, instead of forming sum and difference signals, a (suitably delayed) left channel is predicted from the right channel.

Although the embodiments described show a stereophonic system, it will be appreciated that with, for example, quadrophonic systems, the invention is implemented by forming a sum signal and 3 difference signals, and predicting each from the sum signal as above.

Whilst the invention has been described as applied to a low bit-rate transmission system, e.g. for teleconferencing, it is also useful for example for digital storage of music on well known digital record carriers such as Compact Discs, by providing a formatting means for arranging the data in a format suitable for such record carriers.

Conveniently, much or all of the signal processing involved is realised in a single suitably programmed digital signal processing (dsp) chip package; two channel packages are also commercially available. Software to implement adaptive filters, LPC analysis and cross-correlations are well known.

We claim:

1. Polyphonic signal coding apparatus for transmitting data representing plural correlated channels of audio signals, said apparatus comprising:

means for receiving data representing plural channels of information signals;

generating means connected to the receiving means and responsive to said plural channels for periodically generating channel reconstruction data which, when applied to a plural order predictor filter, enables the prediction of a second of said plural channels from a first of said plural channels thus filtered; and means connected to said generating means for outputting data representing the said first channel data and said channel reconstruction data thereby enabling the reconstruction of said second channel data therefrom.

2. Apparatus according to claim 1, wherein the generating means includes means for generating a plurality of filter coefficients which, when applied to a plural order predictor filter, enables the prediction of a second of said plural channels from a first of said plural channels thus filtered;

and in which the said channel reconstruction data comprises data representing the said filter coefficients.

3. Apparatus according to claim 1 further comprising:

means for filtering the first and second channel in accordance with a filter approximating the spectral inverse of the first channel to produce respective filtered channels, the first said filtered channel thereby being substantially spectrally whitened;

the generating means being connected to receive the filtered channels.

4. Apparatus according to claim 3, wherein said filtering means comprises an adaptive, master, filter arranged to filter the first channel so as to produce a whitened output, and a slave filter arranged to filter said second channel, the salve filter being configured so as to have an equivalent response to the adaptive master filter of the filtering means.

5. Apparatus according to claim 1 further comprising:

input means for receiving input signals; and means for producing the said channels therefrom, the first channel being a sum channel representing the sum of such input signals and the second or further channels representing the differences therebetween.

6. Apparatus according to claim 5 including variable delay means for delaying at least one of the input signals, and means for controlling a differential delay applied to the input signals so as to increase the correlation upstream of the generating means, the output means being arranged to output also data representing the said differential delay.

7. Polyphonic signal coding apparatus comprising:

means for receiving data representing plural channels of information signals;

generating means connected to the receiving means and responsive to said plural channels for periodically generating channel reconstruction data which, when applied to a plural order predictor filter, enables the prediction of a second of said plural channels from a first of said plural channels thus filtered; in which the generating means includes a plural order adaptive filter connected to receive the first channel, said plural order adaptive filter being controlled in dependence on said second channel so that said adaptive filter produces a predicted second channel therefrom, and means for producing a residual signal representing the difference between the said predicted second channel and the second channel, means for outputting data representing the said first channel and channel reconstruction data including data representing said residual signal.

8. Apparatus according to claim 7, in which the adaptive filter is controlled only by the said residual signal and the said channel reconstruction data consists of the said residual signal.

9. Polyphonic signal decoding apparatus comprising:

means for receiving data representing a sum signal and difference signal reconstruction data, said sum signal representing the sum of at least first and second channel signals and said difference signal represents the difference between said at least first and second channel signals;

a configurable plural order predictor filter connected to said receiving means for receiving said difference signal reconstruction data and modifying its coefficients in accordance therewith, the filter being connected to receive the said sum signal and reconstruct therefrom an output difference signal; and means connected to said configurable plural order predictor filter for adding the reconstructed difference signal to the received sum signal, and for subtracting the reconstructed difference signal from the received sum signal, so as to produce at least two output signals representing said at least first and second channel signals respectively.

10. Apparatus as claimed in claim 9, in which the difference signal reconstruction data comprises residual signal data and the apparatus includes means for adding the residual signal data to the output of the filter to form the reconstructed difference signal.

11. Apparatus as claimed in claim 10 in which the configurable plural order predictor filter is connected to receive the residual signal data and to modify its coefficients in accordance therewith.

12. A method of coding polyphonic input signals comprising:

producing a sum signal representing the sum of said input signals;

producing at least one difference signal representing a difference between said input signals;

analyzing said sum and difference signals and generating therefrom a plurality of coefficients to a multi-stage predictor filter, thereby enabling the prediction of the difference signal(s) from the sum signal thus filtered;

outputting data representing the said sum signal and data enabling the reconstruction of the said difference signal(s) therefrom.

13. Polyphonic audio signal coding apparatus for transmitting digital data representing plural correlated channels of audio signals, said apparatus comprising:

data generating means responsive to said plural channels of audio signals for periodically generating a plurality of filter coefficients which, when applied to a plural order predictor filter, enables the prediction of a second of said channels from a first of said channels thus filtered; and output means connected to the data generating means for outputting data representing the said first channel of audio signals and data representing said filter coefficients thus enabling the reconstruction of the said second channel of audio signals therefrom.

14. Apparatus according to claim 13 in which the generating means includes an adaptive plural order filter connected to receive the first channel of audio signals, said adaptive filter being controlled in dependence on said second channel so that said adaptive filter produces a predicted second channel of audio signals therefrom; and including means for producing a residual signal which represents the difference between the said predicted second channel of audio signals and the said second channel of audio signals, and in which the output means is arranged also to output data representing the residual signal.

15. Polyphonic audio signal coding method for transmitting digital data representing plural correlated channels of audio signals, said method comprising:

responsive to said plural channels of audio signals, periodically generating a plurality of filter coefficients which, when applied to a plural order predictor filter, enables the prediction of a second of said channels from a first of said channels thus filtered; and outputting data representing said first channel of audio signals and data representing said filter coefficients thus enabling the reconstruction of the said second channel of audio signals therefrom.

16. Polyphonic audio signal according to claim 15, in which the generating step includes adaptively filtering the first channel of audio signals and producing a predicted second channel of audio signals therefrom; and including the step of producing a residual signal which represents the difference between the said predicted second channel of audio signals and the said second channel of audio signals, and in which the data representing the said residual signal is also output.

17. Polyphonic signal coding method for transmitting data representing plural correlated channels of audio signals, said method comprising:

responsive to said plural channels of audio signals, adaptively filtering a first channel of said plural channels, said adaptive filtering being controlled in dependence on a second of said plural channels, to produce a predicted second channel;

producing a residual signal representing the difference between the said predicted second channel and the said second channel which, when applied to a plural order predictor filter, enables the prediction of the second of said plural channels from the first of said plural channels thus filtered; and outputting data representing the said first channel and data representing the said residual signal.

* * * * *